United States Patent [19]

Stanley

[11] Patent Number: 4,953,697

[45] Date of Patent: Sep. 4, 1990

[54] SELF-RETAINING GOLF BAG COVER EMPLOYING PLAIN SLEEVE

[76] Inventor: Jack M. Stanley, 6989 Polvadero Dr., San Jose, Calif. 95119

[21] Appl. No.: 407,910

[22] Filed: Sep. 15, 1989

[51] Int. Cl.[5] ..... A63B 55/00; B65D 65/02

[52] U.S. Cl. ..... 206/315.400; 150/159; 150/160; 383/75

[58] Field of Search ..... 206/315.4; 383/75, 67; 150/154, 159, 160

[56] References Cited

U.S. PATENT DOCUMENTS

| | | | |
|---|---|---|---|
| D. 256,293 | 8/1980 | Edwards | D3/37 |
| 725,764 | 2/1903 | Pierce . | |
| 1,119,508 | 11/1914 | Headley . | |
| 1,562,030 | 7/1925 | Lawrence . | |
| 1,570,510 | 1/1926 | McQuirk . | |
| 1,617,115 | 2/1927 | Hotze | 206/315.4 |
| 1,700,734 | 3/1929 | Brandt . | |
| 2,014,589 | 9/1935 | Saad | 150/1.5 |
| 2,471,169 | 5/1949 | Salzberg | 150/1.5 |
| 2,552,501 | 5/1951 | Wilkens | 150/1.5 |
| 2,633,173 | 3/1953 | Reed | 150/160 |
| 2,704,563 | 3/1955 | Henrich | 150/1.5 |
| 2,718,251 | 9/1955 | Barbato | 150/52 |
| 2,747,636 | 5/1956 | Couture | 150/160 |
| 2,749,958 | 5/1956 | Innes | 150/1.5 |
| 2,907,364 | 10/1959 | Trenery | 150/52 |
| 2,925,840 | 2/1960 | Hird | 150/160 |
| 2,973,794 | 3/1961 | Erickson | 150/52 |
| 2,985,212 | 5/1961 | Dozier | 150/52 |
| 3,059,681 | 10/1962 | Lorbeski | 150/52 |
| 3,093,295 | 6/1963 | Kugler | 383/67 |
| 3,521,689 | 7/1970 | Woods, Jr. | 150/1.5 |
| 3,620,276 | 11/1971 | Taylor | 150/159 |
| 3,754,587 | 8/1973 | Rainieri | 150/159 |
| 3,797,043 | 3/1974 | Brument | 383/75 |
| 3,913,648 | 10/1975 | Sessler | 150/1.5 R |
| 3,977,451 | 8/1976 | Duba | 150/1.5 R |
| 3,985,171 | 10/1976 | Summers et al. | 150/52 G |
| 4,200,133 | 4/1980 | Whitlow | 150/159 |
| 4,234,025 | 11/1980 | Berge | 206/315.4 |
| 4,249,586 | 2/1981 | Setani | 150/1.5 C |
| 4,498,579 | 2/1985 | Brick | 206/315.4 |
| 4,522,300 | 6/1985 | Hamblet | 206/315.4 |
| 4,699,164 | 10/1987 | Pilney et al. | 206/315.4 |
| 4,752,004 | 6/1988 | Very | 206/315.4 |

*Primary Examiner*—Stephen P. Garbe

[57] ABSTRACT

An improved golf bag cover (10) for protecting the golf bag (24), including its golf clubs (30), towel (28), and othe accessories and objects from rain, mud, dirt, and dust during play or while equipment is stored. The cover (10) is composed of a clear, flexible, water impervious plastic, such as polyethylene. It is made in the form of a tubular sleeve of suitable flexibility and strength. The cover (10) is open on both ends with connected drawcords (20*a*) and (20*b*) at the top for opening or closing it. The cover can be slipped over to surround the clubs (30), towel (28), and the upper part of the bag (24) and straps (26). Thereupon it is drawn closed at the top. Cover (10) at the top can be pulled open in seconds for convenient access to the clubs (30) and dry towel (28). After the selected club is withdrawn, the cover is immediately drawn closed again until the club is returned. The cover fits all bags and is practical for use whether the golf bag (24) is placed on a hand cart, electric or gas cart, or hand carried by a strap (26). This golf bag cover can be manufactured cheaply and simply.

2 Claims, 2 Drawing Sheets

SELF-RETAINING GOLF BAG COVER EMPLOYING PLAIN SLEEVE

BACKGROUND

1. Field of Invention

This invention relates to protective covers, specifically to a protective cover for a golf bag, including its golf clubs, towel, and other accessories and objects.

2. Description of Prior Art

Heretofore, golfers have not been able to obtain any practical and inexpensive rain and protective cover for golf equipment which is carried in a bag during play.

While there are covers for traveling which enclose an entire bag and clubs, these covers do not provide access to the clubs during play unless the golfer completely removes the cover.

Some bags, not all, have built in snaps around the top of the bag. These provide a snap-on cover, usually with a zipper, to gain access from the side. Again, this feature is primarily to contain the clubs in the bag during travel. This cover is not practical to use in the rain because to identify and get clubs in and out is awkward and slow. U.S. Pat. No. 3,977,451 to Duba (1976) shows a cover of the type just described. Duba attached a cover to the snap-on cover, making access to the clubs no less awkward than before.

A large and growing number of light carry bags do not have any type of cover to protect the clubs and accessories during play in wet conditions. U.S. Pat. No. 3,913,648 to Sessler (1975), 1,562,030 to Lawrence (1925), 3,059,681 to Lorbeski (1962), 256,293 to Edwards (1980), and 2,749,958 to Innes (1956) are examples of prior-art covers that require some combination of cumbersome parts, fasteners, precision fittings, rigid supports, new toolings, or specialized manufacturing procedures. These covers would be quite expensive and cumbersome for the average golfer to use on a light carry bag.

In addition to being too expensive, most prior-art covers fail to provide certain practical essentials for a good rain cover. The following few, but not inclusive, examples will summarize these failings.

U.S. Pat. No. 2,973,794 to Erickson (1961) shows a cover which contains rigid rim members which are unsatisfactory for storage in a golf bag; thus user will not be able to obtain the cover quickly when needed. U.S. Pat. No. 2,704,563 to Henrich (1955) shows a cover which has fasteners that require a relatively long time to assemble in a sudden rain burst.

Bags today have the upper end of the carry strap fixed at the very top of the bag. In observation of this fact, regarding U.S. Pat. No. 4,752,004 to Very (1988), the belt binding Very's cover to the bag would also bind a portion of the strap, causing unbalanced carrying. U.S. Pat. No. 4,200,133 to Whitlow (1980) shows a cover which binds to the bag and top end of the strap with an elastic bottom. Whitlow's cover would tend to be pushed off the bag when the top of the strap is tauted for carrying. Whitlow's cover also makes access to the clubs awkward due to the tubular sleeve length and small opening of the cover.

U.S. Pat. No. 4,498,579 to Brick (1985) shows a cover with an elastic bottom. When this bottom is partially removed from the rim of the bag for club access, the elastic will tend to contract, thereby obstructing club removal. Therefore the cover must be completely removed for club access, a procedure which is slow and awkward. As regards U.S. Pat. No. 4,699,164 to Pilney and Wood (1987), access to return of the clubs is clumsy, especially when one needs access to the particular club enclosed in the elastic sock.

Finally, certain prior-art covers would not fit, without changes, many bags manufactured today. U.S. Pat. No. 3,521,689 to Woods, Jr. (1970) is an example of this. Other covers afford protection primarily only to scuffing and nicking, especially wooden head clubs. U.S. Pat. No. 2,925,840 to Hird (1960) and 3,985,171 to Summers (1976) are examples of such covers.

OBJECTS AND ADVANTAGES

Accordingly, several objects and advantages of the present invention are:

(a) to provide a cover which is extremely inexpensive to manufacture and which utilizes existing tooling and standard manufacturing procedures;

(b) to provide a cover which can be folded to a small size and stored in a golf bag or elsewhere until needed;

(c) to provide a cover which can be applied instantly and simply;

(d) to provide a cover which will stay in position so that a golfer can carry the golf bag by hand unhampered and unhindered by the presence of the cover on the bag; and (e) to provide a cover, which, when in place, enables a golfer to have immediate and unobstructed access to the golf clubs.

Further objects and advantages are to provide a cover made of clear, seethrough, polyethylene for easy identification of clubs and which fits all bags, whether carried by hand or on a cart. Still further objects and advantages will become apparent from a consideration of the ensuing description and drawings.

REFERENCE NUMERALS IN DRAWINGS

Figure 1:
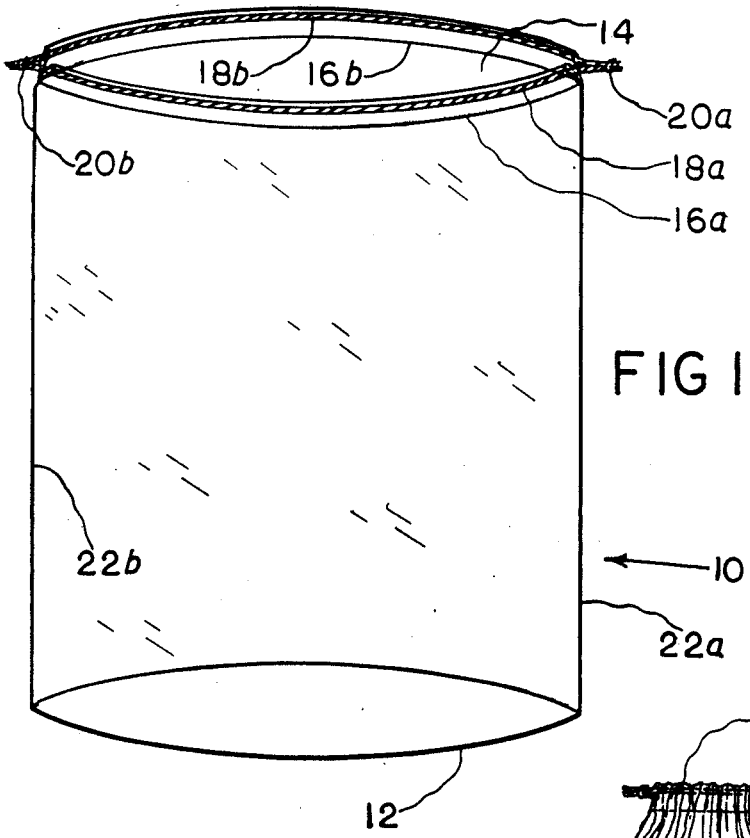
FIG. 1 shows an opened view of a rain and protective cover in the form of a tubular sleeve in accordance with the invention.

10 Rain and protective cover
12 Open lower end of cover
14 Open upper end of cover
**14*a*** Closed upper end of cover
**16*a*** Front side heat sealed fold to encompass cord
**16*b*** Back side heat sealed fold to encompass cord
**18*a*** Front side cotton cord
**18*b*** Back side cotton cord
**20*a*** Right side front and back cord ends clamped together for drawing cover closed
**20*b*** Left side front and back cord ends clamped together for drawing cover closed
**22*a*** Right side front and back heat sealed
**22*b*** Left side front and back heat sealed
24 Golf bag
26 Bag strap
28 Golf towel
30 Golf clubs
32 Golf bag pocket

DESCRIPTION OF THE INVENTION

FIG. 1 shows a rain and protective cover 10 according to the invention. It comprises a tubular sleeve with an open lower end 2 and an open upper end 14. Cover 10 has a uniform diameter from bottom 12 to top 14 of approximately 46 centimeters and is made of a water-impervious material, preferably clear, flexible, plastic polyethylene sheeting about 100 microns thick.

Figure 2:
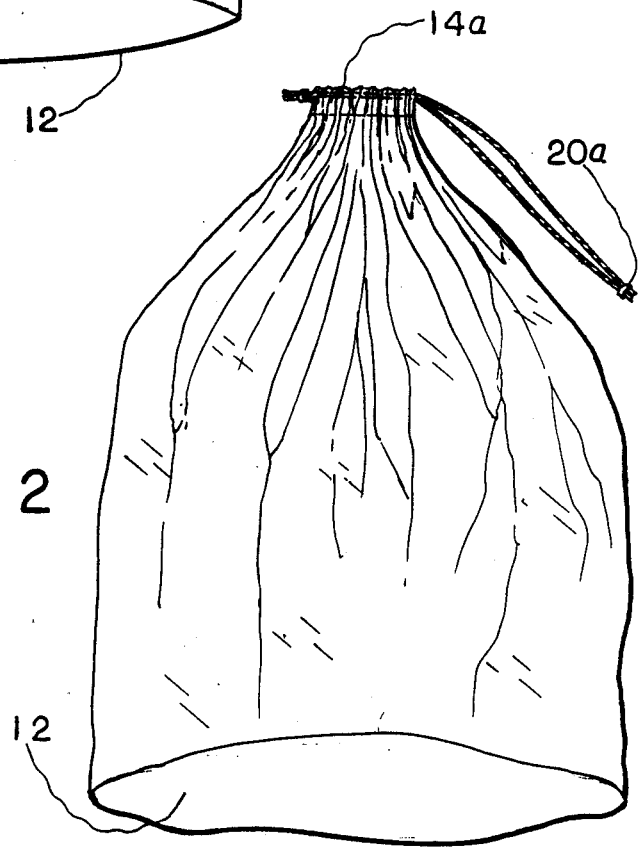
FIG. 2 shows a perspective view of the sleeve with its upper end drawn closed.

Upper end 14 has two, half-circumference length, heat-sealed folds, front 16*a* and back 16*b*, approximately three centimeters high. These folds are formed by folding a portion of the top of the cover in and heat sealing it to the main body of the cover 10, thus forming two drawcord channels, or one channel with two openings at diametrically opposit sides. Two cotton cords 18*a* and 18*b* are threaded through the front and back portions of the channels, respectively. On the right side, the ends of each cord extend out of the opening. On the left side, the ends of each cord also extend out of the opening. The corresponding ends of the cord thus meet outside the fold. Both cord ends are connected by clamping them together with respective small metal clamps on right side 20*a* and left side 20*b*. The clamps prevent the extending ends of the cords from being pulled back into the channel. These connected drawcord ends are the means by which upper end 14 of cover 10 is opened and closed to form a closed end 14*a* as shown in FIG. 2.

Figure 3:
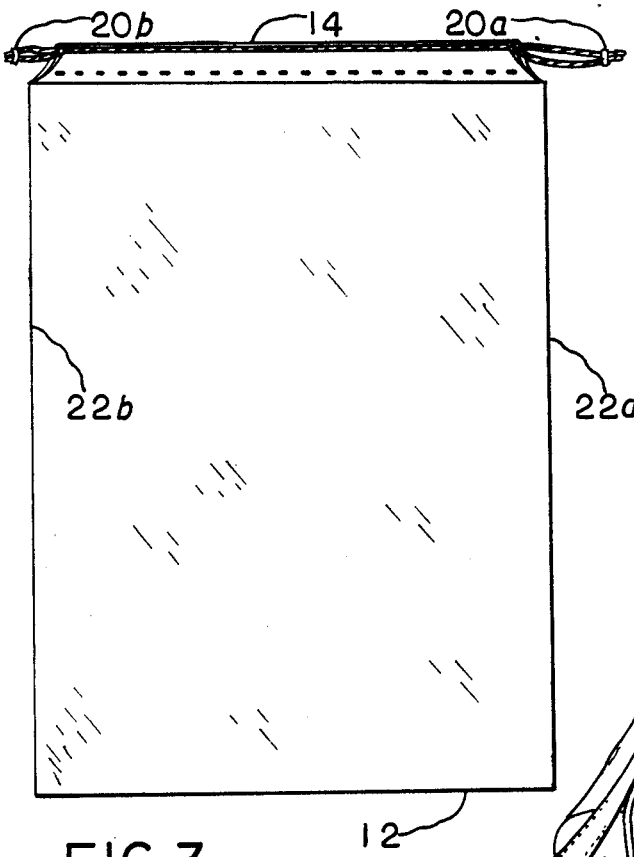
FIG. 3 is a plan view of the tubular sleeve in a flat condition.

FIG. 3 shows cover 10 in a flat condition so that only its front side is seen. Cover 10 is made of two panels, one in front and one in back, each about 66 centimeters high. On the right edge, both panels are connected by a heat sealed seam 22*a*, and on the left edge, both panels are connected by a heat sealed seam 22*b*. Bottom 12 is open and contains no elastic, weights, or fasteners; it is machine cut only and need not be rolled. Alterartively the cover can be made of a continuous single cylinder of plastic without seams.

Figure 4:
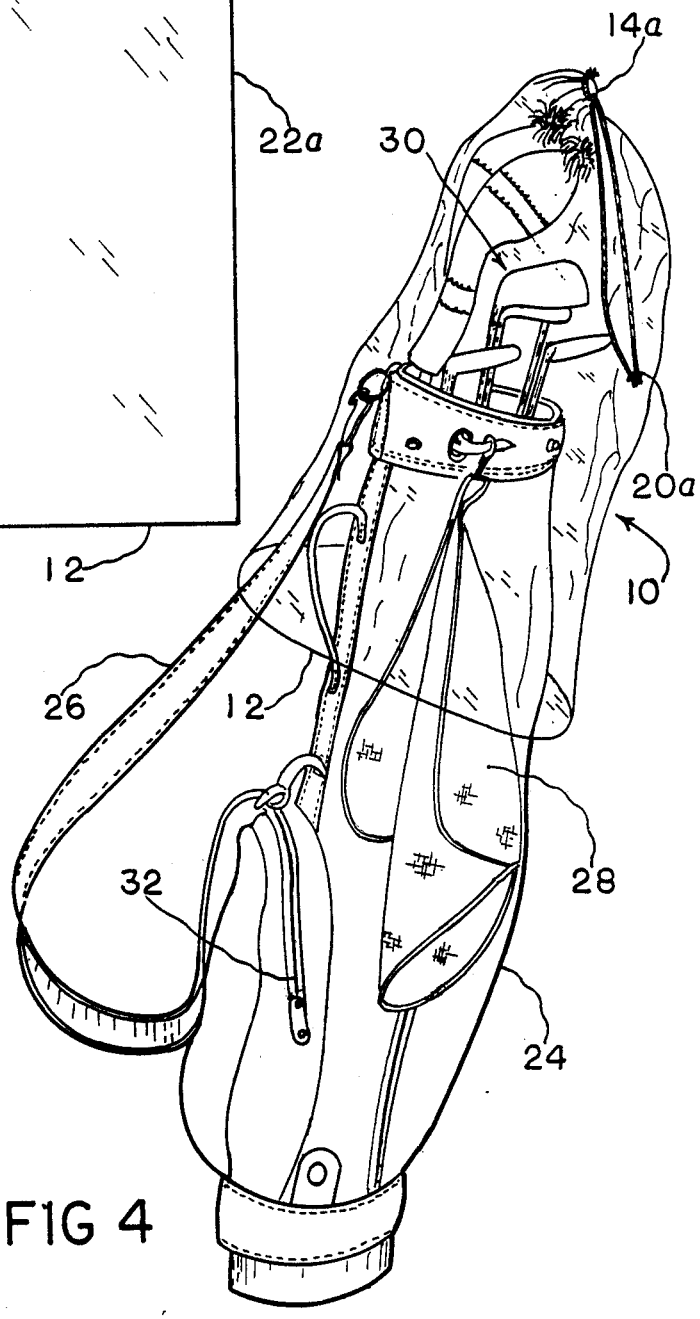
FIG. 4 is a perspective view of a bag of golf clubs with the rain cover over the top and closed.

FIG. 4 depicts cover 10 mounted on a golf bag 24 with its upper end closed at 14*a*. The length of cover 10 is approximately 66 centimeters which is adequate to cover clubs 30 and a top portion of bag 24 and its strap 26. The crushable or non-form retaining material of cover 10 adheres in a practical fashion over clubs 30 and may be folded to a compact form for easy storage in bag 24. In volume, cover 10 can be manufactured and delivered for approximately 50 cents per unit with existing tooling and know-how.

OPERATION

Cover 10 is folded and stored in a pocket 32 of golf bag 24 when not in use. Then, to protect clubs in storage or when it rains during play, the golfer removes, unfolds, and places cover 10 over clubs 30 and bag 24 and closes top opening 14 as shown in FIG. 4. If desired, before closing cover 10, an attached towel 28, or unattached towel (not shown) may be lifted and placed over clubs 30 and under cover 10 to keep towel 28 dry so that it can be used to dry the golfer's wet hands.

More specifically, to position cover 10, the golfer takes its open lower end 12, slips it over so that it surrounds clubs 30 and a top portion of bag 24 and strap 26. At this point, open upper end 14 (FIG. 1) is approximately parallel with the tops of clubs 30. Upper end 14 is then drawn closed by clamped drawcords 20*a* to form closure 14*a*. The top stays closed by friction of the drawcords against the flexible, yet adhesive nature of polyethylene when it is shirred or gathered. No tying or knotting is required. Thus, cover 10 appears as shown in FIG. 4. Cover 10 is held in place by weight, gravity, and the adhering nature of its pliable polyethylene material.

To open cover 10 for club selection, the user simply grasps, with his or her right thumb and forefinger, the top right side of cover 10 below closure 14*a*. At the same time, the user grasps the top left side of cover 10 below closure 14*a* with his or her left thumb and forefinger. The user then pulls these sides in opposite directions so as to cause top 14 to expand to a fully opened position. After a club is withdrawn, the golfer can close cover 10 from the right side by grasping drawcords 20*a* and drawing them to the right. At the same time, with the left thumb and forefinger, the golfer slides the polyethylene material to the left along front heat sealed fold 16*a* and back fold 16*b* toward a fully closed position as shown at 14*a*. Cover 10 can also be closed from the left side by grasping drawcords 20*b* and drawing them to the left. At the same time, with the right thumb and forefinger, the golfer slides the polyethylene material to the right along front heat sealed fold 16*a* and back fold 16*b* toward a fully closed position as shown at 14*a*. I have found that closed end 14*a* retains itself in position whether bag 24 and clubs 30 are carried in a golf cart or by hand.

If bag 24 is to be carried by hand, bag 24 is lifted by carrying strap 26. When strap 26 is tauted to carry bag 24, the material of cover 10 on the side of strap 26 simply gathers in a pulled up fashion at the top end of strap 26, thereby tightening the cover around bag 24. The adhering nature and the surrounding tightness of the cover material makes it stay in place. Weight and gravity are additional factors which hold cover 10 in place. When cover 10 is not longer needed, it is simply removed, folded, and stored in pocket 32 for future use.

SUMMARY, RAMIFICATIONS, AND SCOPE

The reader will thus see that I have provided a golf bag cover which can be made at very low cost by utlizing standard stock material and by applying established and routine manufacturing procedures. The cover can be folded to a small size and stored in a golf bag so that it can be taken out for immediate use.

When needed, the cover can be positioned quite simply over the clubs and bag in a matter of seconds. It will fit all bags and stay in position without hindering the golfer, whether the bag is carried by hand or on a cart.

The cover material is of a clear, transparent, plastic polyethylene, affording the golfer easy identification of clubs for selection. The practical means by which the cover is opened and closed at the top provides unhindered access to clubs for rapid removal and replacement.

Although the cover is relatively simple in form and construction, I have found that it retains itself on golf bags as well as or better than far more expensive and complex covers; yet, it is far easier, simpler, and efficient to use.

While my above description contains many specificities, these should not be construed as limitations on the scope of the invention, but rather as an exemplification of one preferred embodiment thereof. Many variations are possible.

The cover can be used to keep rain or insects off food during tailgate parties or picnics. Large open dish food containers are commonly used at these affairs. The cover can surround and seat itself under the food container and be closed at the top or opened for access to the food.

Another use can be as a rain protector for mail bags. The cover can be slipped over to surround the mail bag which is usually bulging with papers and mail exposed outside the bag. The simple opening and closing makes it very practical as a mail bag rain cover.

The cover can be made in a wide range of sizes and materials with various types of adjustments, e.g., opaque plastic, treated vinyl, rubberized dipped cloth, nylon mesh, material with grommeted holes, rivet sealed channels, channels formed by glued on tubes, etc.

Thus the scope of the invention should be determined by the appended claims and their legal equivalents, rather than by the examples given.

I claim:

1. A covered container comprising a container and a cover for protecting objects in said container comprising:

(a) a container, said container comprising a golf bag having a plurality of golf clubs in said bag, said bag having an open top end through which said clubs can be removed from said bag, said cover being positioned over said open top end of said bag, (b) a cover comprising a tubular sleeve of flexible material for slipping over and surrounding at least a top part of said container, said sleeve having a loose, open bottom that is plain, continuous, smooth, imperforate, and free of any fastening means or discontinuity, (c) said sleeve having a drawcord mounted in a top portion thereof so that said top can be opened and closed by means of said drawcord so as to provide access to the top of said container or cover the top of said container, (d) said cover having a uniform diameter of about 46 centimeters, a length of about 66 centimeters, and a thickness of about 100 microns.

2. A cover for protecting a golf bag, comprising:

(a) a tubular sleeve of flexible material for slipping over and surrounding at least a top part of said container, said sleeve having a loose, open bottom that is plain, continuous, smooth, imperforate, and free of any fastening means or discontinuity, (b) said sleeve having a drawcord mounted in a top portion thereof so that said top can be opened and closed by means of said drawcord so as to provide access to the top of said container or cover the top of said container, (c) said sleeve having a uniform diameter of about 46 centimeters, a length of about 66 centimeters, and a thickness of about 100 microns.

* * * * *